United States Patent [19]

Kato

[11] Patent Number: 4,908,176

[45] Date of Patent: Mar. 13, 1990

[54] PROCESS FOR PRODUCING MOLDABLE NON-WOVEN FABRICS

[75] Inventor: Naoyuki Kato, Mie, Japan

[73] Assignee: Mitsubishi Yuka Badische Co., Ltd., Yokkaichi, Japan

[21] Appl. No.: 124,388

[22] Filed: Nov. 19, 1987

Related U.S. Application Data

[63] Continuation of Ser. No. 841,819, Mar. 20, 1986, abandoned.

[51] Int. Cl.[4] ..... D04H 1/00

[52] U.S. Cl. ..... 264/122; 264/128; 428/290; 427/370

[58] Field of Search ..... 264/122, 123, 126, 128; 428/290; 427/370

[56] References Cited

U.S. PATENT DOCUMENTS

| | | | |
|---|---|---|---|
| 3,870,557 | 3/1975 | Fink | 428/290 |
| 4,083,913 | 4/1978 | Marshall | 264/122 |
| 4,229,397 | 10/1980 | Fukuta | 264/122 |
| 4,251,581 | 2/1981 | Schoppa | 428/290 |
| 4,397,899 | 8/1983 | Marsh | 428/290 |
| 4,451,315 | 5/1984 | Miyazaki | 428/290 |
| 4,476,182 | 10/1984 | Fink | 428/296 |

FOREIGN PATENT DOCUMENTS

| | | |
|---|---|---|
| 0158156 | 10/1985 | European Pat. Off. . |
| 2096195 | 10/1982 | United Kingdom . |

*Primary Examiner*—Sam Silverberg

*Attorney, Agent, or Firm*—Oblon, Spivak, McClelland, Maier & Neustadt

[57] ABSTRACT

A process for producing a moldable non-woven fabric is disclosed, which comprises coating or impregnating a mat made of non-woven fabrics with an aqueous emulsion of a thermoplastic resin having a moldable temperature range of from 80° to 180° C. in such an amount that the resin solids content of the emulsion is 15 to 300 wt % based on the weight of the mat, removing the moisture from the mat by heating, and pressing the mat to adjust the apparent density of the mat to 0.15 to 0.5 g/cm$^3$. This fabric is useful as an interior material for use in an automobile, for example.

10 Claims, No Drawings

PROCESS FOR PRODUCING MOLDABLE NON-WOVEN FABRICS

This application is a continuation of application Ser. No. 06/841,819 filed on Mar. 20, 1986, now abandoned.

FIELD OF THE INVENTION

The present invention relates to a process for producing non-woven fabrics which have stiffness and elasticity sufficient to deep draw forming and thus are useful as interior materials such as the ceiling, door, rear package, seat back and luggage of an automobile.

BACKGROUND OF THE INVENTION

As interior materials, resin felts comprising a phenol-aldehyde condensation resin with fibers charged thereto, foamed article of synthetic resins, polypropylene composites, cardboard of polypropylene, and the like which are resistant against temperatures of 100° C. or more have been used. Of those materials, the resin felt is excellent in stiffness, shape-holding properties after heat circulation (thermal resistance), and dimensional stability, but has disadvantages in that moldability, impact resistance, air permeability and lightness are poor. The cardboard or polypropylene is excellent in stiffness and lightness, but is inferior in air permeability. Moreover, since a corrugate material is used, the strength is critical in direction. The foamed article of synthetic resin such as cross-linked polystyrene is excellent in lightness, but has disadvantages in that shape-holding stability after heat circulation and bending properties are poor. Material satisfying all the requirements as an interior material, such as stiffness, proper flexibility, lightness, dimensional stability, shape-holding properties after heat circulation (thermal resistance), and moldability has not been obtained.

A method for producing non-woven fabrics having good elasticity comprising temporarily fixing fibers of the top and bottom layers of web by needling a fiber mat of synthetic fibers with fibers of polyethylene, polypropylene, polyester having a low melting point (e.g., 140° C.) and the like as a fiber binder, and melting the above fiber binder by heating to thereby bind the other synthetic fibers is known. This non-woven fabric is good in lightness and flexibility, but is inferior in moldability and stiffness. Therefore, such non-woven fabric is useful as an interior material which is used in a flat place, but is not useful as an interior material which is used in a complicated place.

An interior material for automobile produced by impregnating or coating a needle punch cloth with an aqueous emulsion of a thermoplastic resin having a softening point of 100 to 130° C., heating and drying the cloth to remove water and obtain a moldable non-woven fabric, and then further heating and press molding (compression molding) the fabric is known. This interior material has an advantage in that it can be used in a place of complicated form. Mechanical bond of fibers of the non-woven fabrics is conducted by intertwining the fibers each other and attaching the emulsion resin to the fibers. However, since the apparent density of the non-woven fabrics which are coated or impregnated with the emulsion resin is as high as 0.08 to 0.13 g/cm$^3$, the effect of filling spaces between fibers with the emulsion resin is poor.

As a process for producing non-woven fabrics which are improved in the inherent disadvantages of dimensional stability and stiffness of the moldable nonwoven fabric without reducing the lightness, shape-holding properties after heat circulation, and air permeability, the present inventors have proposed a process in which a fiber mat comprising 15 to 50 wt% of a thermoplastic resin binder fibers and 85 to 50 wt% of synthetic fibers or natural fibers having a melting point of more than 40° C. higher than that of the thermoplastic resin is needled, the mat is heated at a temperature at which the thermoplastic resin binder fibers are melted but the synthetic or natural fibers are not melted, the fiber mat is pressed while the thermoplastic resin binder fibers maintain a molten state, to thereby adjust the apparent density of the mat to 0.15 to 0.50 g/cm$^3$, the pressed mat is coated or impregnated with an aqueous emulsion of a thermoplastic resin having a moldable temperature range of 80 to 180° C. in such an amount that the resin content of the emulsion is 15 to 300 wt% based on the weight of the fibers in the fiber mat, and then the mat is heated to 60 to 250° C. and dried to remove water and obtain the desired non-woven fabrics as disclosed, for example, in Japanese Patent Application (OPI) No. 87353/83 (the term "OPI" as used herein refers to a "published unexamined Japanese patent application").

This method has a great feature in that the stiffness of the non-woven fabrics is increased by using the fiber binder made of a thermoplastic resin in combination with the resin emulsion, the dimensional stability is increased by bonding the fibers each other, and the stiffness of the non-woven fabrics is increased by removing a part of air by compressing the fiber mat before coating or impregnating with the emulsion resin to thereby increase the filling efficiency of the emulsion resin into the mat (i.e., the amount of the emulsion resin which fills spaces between fibers of web).

This process for producing moldable non-woven fabrics requires a preceding heating step to melt the binder fibers and a subsequent heating step to dry the resin emulsion, and this is disadvantageous from a standpoint of heat energy.

SUMMARY OF THE INVENTION

An object of the present invention is to provide a process for producing moldable non-woven fabrics having good elasticity, which can omit one heating step by controlling the resin content of an emulsion coated on the non-woven fabrics and the compression ratio of the mat.

The process for producing moldable non-woven fabrics according to the present invention comprises coating or impregnating a mat made of non-woven fabrics with an aqueous emulsion of a thermoplastic resin having a moldable temperature range of 80 to 180° C. in such an amount that the solids content of the emulsion is 15 to 300 wt% based on the weight of the fiber in the non-woven fabric mat, heating and drying the mat to remove water, and then compressing the non-woven fabric mat to control the apparent density of the mat to 0.15 to 0.5 g/cm$^3$

DETAILED DESCRIPTION OF THE INVENTION

The non-woven fabric mat which can be used in the present invention is produced by feeding synthetic fibers and/or natural fibers having a size of 1.2 to 300 denier and a fiber length of 2.5 to 150 mm which are fully mixed and split in a web-producing unit, and superposing cards made of the fibers on each other in such an amount that the desired web weight per unit area is attained.

As the starting material for synthetic fibers, thermoplastic resin such as polyethylene terephthalate, polyamide and polypropylene are used. In addition, as natural fibers, cotton, flax, wool and the like are used. These may all be waste (reused).

In controlling the apparent density during compression, it is convenient that a fiber mixture of 15 to 50 wt% of a thermoplastic resin fiber binder and 85 to 50 wt% of synthetic or natural fibers having a melting point of more than 40° C. higher than that of the thermoplastic resin is used as the material for the non-woven fabric mat.

A web (fiber mat) comprising superposed cards of the above fibers is sticked with a needle in a vertical direction and the fibers are crossed in the vertical direction so that all the cards are temporarily combined together (so-called needling).

This fiber mat is coated or impregnated with an aqueous emulsion of a thermoplastic resin in such an amount that the solids content in the emulsion is 15 to 300 wt%, preferably 30 to 150 wt%, based on the weight of the fiber mat, and then heated and dried at a temperature higher than the melting point of the emulsion resin to remove the water whereupon the desired moldable nonwoven fabrics are produced. Particularly when the mat uses the fiber binder, controlling the apparent density can be facilitated by heating it to a temperature at which not only the emulsion resin but also the fiber binder are melted.

The thermoplastic resin for the emulsion used for impregnation of the fiber mat has a moldable temperature range (glass transition point) of 80° C. or more, preferably 120 to 180° C., and a particle diameter of 0.01 to 5 microns. More specifically, styrene/lower ester of acrylic acid (having 2 to 6 carbon atoms in the ester moiety) copolymers, methacrylate/lower ester of acrylic acid copolymers, vinylidene chloride copolymers (vinylidene chloride content is 85 wt% or more), styrene/ diene copolymers and other thermoplastic resins can be used. Some of them are sold under the trade names of Acronal®YJ-1100D, 8393D and 7082D, and Diofan®192D by Mitsubishi Yuka Badische Co., Ltd.

Means to coat or impregnate the fiber mat with the emulsion include licker roll, squeeze roll, spray gun, and dipping. In general, to ensure the impregnation of the fiber mat with the emulsion, the emulsion coated is squeezed under pressure by passing through squeeze rolls.

Coating of the emulsion can be carried out from only one side or both sides of the fiber mat. The impregnation can be applied onto the entire surface of the fiber mat, or in such a manner that the central portion of the mat remains unccated, or in such a manner that one side of the mat remains partially uncoated. By designing such that the fiber mat is not partially impregnated, the cushioning properties of the non-woven fabrics can be prevented from being extremely decreased.

In order to impart a heavy feeling to the non-woven fabrics, a filler such as calcium carbonate, iron oxide, ferrite, and barium sulfate can be compounded to the emulsion, or in order to provide the non-woven fabrics with moldability, a powder of a low melting point resin such as low density polyethylene or polystyrene, and an ethylene/vinyl acetate copolymer can be compounded to the emulsion.

The fiber mat with the emulsion coated or impregnated is then heated to a temperature higher than the melting point of the emulsion resin to remove the moisture, whereupon the moldable non-woven fabrics having an apparent density of 0.15 to 0.5 g/cm$^3$, preferably 0.17 to 0.3 g/cm$^3$, can be obtained. In this heat drying step, some of the resin particles in the emulsion are present in the fiber mat in the form of particles and some of them form a film, to thereby increase the binding between the fibers each other and provide the fiber mat with moldability and stiffness.

The reason why the apparent density of the moldable non-woven fabrics is controlled to 0.15 to 0.5 g/cm$^3$ is as follows. If the apparent density is less than 0.15 g/cm$^3$, the effect of the binder such as the emulsion resin and fiber binder of filling the space in the mat to bind the fibers each other is low, and also the binding force between the fibers is low and the fibers are easily taken out. On the other hand, if the apparent density is more than 0.5 g/cm$^3$, the fiber layer becomes dense, and its elasticity is poor like the resin felt. Moreover, the air permeability is lowered.

The non-woven fabrics thus provided with moldability are then heated to a temperature higher than the melting point of the emulsion resin and compression molded into the desired form, whereupon a molding well balanced in stiffness and elasticity is obtained. In this case, when the non-woven fabrics are superposed on a decorating paper, a propylene sheet, an ABS leather sheet, a polyvinyl chloride leather sheet, a tuffted carpet, a molding the surface of which is decorated can be obtained. When a reinforcing material such as a ply wood, a resin felt, and a cardboard is used in place of the above sheet, a composite molding in which the reinforcing material and the non-woven fabrics are integrally bonded can be obtained.

The moldable non-woven fabrics obtained by the process of the present invention can be used, in addition to an interior material of an automobile, as a flooring material in the house, and a slide-preventing material bonded to the surface of a deck board of a pallet. The present invention is described in greater detail by reference to the following non-limiting examples. Unless otherwise indicated, all parts and percents are by weight.

EXAMPLE 1

A fiber mat (870 g/m$^2$) prepared by superposing at random layers of mixed fibers comprising 20% of a recovered polypropylene (m.p.: 164° C.) fiber binder having a fiber length of about 100 mm (15 denier) and recovered polyethylene terephthalate (m.p.: 264° C.) fibers having a fiber length of 75 to 125 mm (15 denier) was subjected to needling at a ratio of 50 per square inch using 15-18-32-3RB needle (thickness: about 7.5 mm).

The apparent density of the web subjected to the above needling was 0.12 g/cm$^3$, and its bending strength, tensile strength and tensile elongation were as follows:

| Physical Properties | Longitudinal Direction |
|---|---|
| Bending Strength (g/3 cm width) | 0 |
| Tensile Strength (kg/3 cm width) | 75 |
| Tensile Elongation (%) | 18 |

Bending Strength

A test piece (120 mm length and 30 mm width) was fixed at one end, and at a position 100 mm apart from the fixed point, a load is applied in a vertical direction at a rate of 50 cm/min using Instron tester, and the bending resistance value was measured.

The web subjected to the above needling was coated with an aqueous emulsion of an acrylate/styrene copolymer ("Acronal YJ-7082D", produced by Mitsubishi Yuka Badische Co., Ltd.; resin softening point: about 120° C.; resin particle diameter: 0.1 to 0.3 micron; solids content: 50%) in such an amount that the resin content was 350 g/m$^2$, and then the emulsion was allowed to impregnate into the web using a nip roll.

The water in the emulsion was then removed using a cylinder drier (190° C.) while at the same time melting the emulsion resin, and the web was formed into a 5.0 mm thickness using a cooling roll to ensure the binding of fibers of cooled fiber binder made of a thermoplastic resin.

The moldable non-woven fabrics thus prepared had the bending strength of 254 g/3 cm width and the apparent density of 0.17 g/cm$^3$.

This moldable non-woven fabrics were good in air permeability.

The air permeability was measured as follows:

The non-woven fabrics were heated to 190° C. and compression molded at 0.35 kg/cm3G to produce a tray-form container having a length of 200 mm, a width of 200 mm and a depth of 20 mm. Water was placed in the container. Its air permeability was rated as follows:

○: Water leaks immediately and continuously from the container.

Δ: Water permeates through the container and drops intermittently.

×: Water does not permeate through the container at all.

The non-woven fabrics were heated to 200° C. and press molded. As a result, a molding completely conforming to the shape of the mold can be obtained.

EXAMPLES 2 to 5 AND COMPARATIVE EXAMPLES 1 TO 3

The procedure of Example 1 was repeated except that the resin solids content of the emulsion compounded to the fiber mat was 250 g/m$^2$, and the pressure of the cooling roll was changed so as to provide thicknesses as shown in Table 1.

The moldable non-woven fabrics and moldings having physical properties shown in Table 1 were obtained.

TABLE 1

| | Non-woven Fabrics | | | | | |
|---|---|---|---|---|---|---|
| Example No. | Thickness (mm) | Apparent Density (g/cm$^3$) | Air Permeability | Stiffness*1 | Bending Strength (g/3 cm width) | Molding Mold Conformity*2 |
| Comparative Example 1 | 1.5 | 0.58 | x | ◎ | 300 or more | ○ |
| Example 2 | 2.0 | 0.44 | Δ | ◎ | 286 | ○ |
| Example 3 | 3.0 | 0.29 | ○ | ◎ | 220 | ○ |
| Example 4 | 4.0 | 0.22 | ○ | ○ | 194 | ○ |
| Example 5 | 5.0 | 0.17 | ○ | ~Δ | 162 | ○ |
| Comparative Example 2 | 6.0 | 0.145 | ○ | x | 73 | Δ |
| Comparative Example 3 | 7.5 | 0.12 | ○ | x | 0 | x |

*1◎: Very good
○: Good
Δ: Ordinary
x: Bad
*2○: Good
Δ: Ordinary
x: Bad

While the invention has been described in detail and with reference to specific embodiments thereof, it will be apparent to one skilled in the art that various changes and modifications can be made therein without departing from the spirit and scope thereof.

What is claimed is:

1. A process for producing a moldable non-woven fabric, which comprises:

coating or impregnating a mat formed from a fiber mixture of from 15–50 wt. % of thermoplastic resin fibers and from 85–50 wt. % of synthetic or natural fibers having a melting point of more than 40° C. higher than the thermoplastic resin of the thermoplastic fibers with an aqueous emulsion of a thermoplastic resin which is moldable over a temperature of 80°–180° C. in an amount such that the resin solids content in the emulsion ranges from 15 to 300 wt. % based on the weight of the non-woven fabric mat;

heating the emulsion coated or impregnated mat to a temperature greater than the melting point of the resin of the emulsion in order to remove water therefrom; and then compressing the dried mat at a temperature above the melting point of the resin of the emulsion, thereby obtaining a molded product, thereby obtaining a mat whose density is controlled to within the range of 0.15 to 5 g/cm$^3$.

2. The process of claim 1, wherein the dried emulsion coated or impregnated mat has an apparent density ranging from 0.17–0.3 g/cm$^3$.

3. The process of claim 2, wherein said non-woven fabric mat is prepared by feeding synthetic fibers and/or natural fibers having a size of 1.2 to 300 denier and a fiber length of 2.5 to 150 mm, said fibers being fully mixed and split, to a web-producing unit, and then superposing cards made of the fibers onto each other in such amounts that the desired web weight per unit area is obtained.

4. The process of claim 1, wherein said natural fibers are cotton fibers, flax fibers or wool fibers.

5. The process of claim 1, wherein said thermoplastic resin fibers or said synthetic fibers are fibers of polyethylene terephthalate, polyamide or polypropylene.

6. The process of claim 2, wherein the thermoplastic resin solids content of said emulsion ranges from 30 to 150 wt. %.

7. The process of claim 2, wherein said thermoplastic resin of the aqueous emulsion has a moldable temperature ranging from 120 to 180° C.

8. The process of claim 2, wherein the particles of thermoplastic resin in said emulsion range in size from 0.01 to 5 microns in diameter.

9. The process of claim 2, wherein the thermoplastic resin of said emulsion is a styrene-lower ester of acrylic acid copolymer, a vinylidene chloride copolymer, a methacrylate-lower ester of acrylic acid copolymer, or a styrene-diene copolymer.

10. The process of claim 2, wherein said emulsion contains a filler and/or a powder of a low melting point resin.

* * * * *